US006843683B2

(12) United States Patent
Cheng

(10) Patent No.: US 6,843,683 B2
(45) Date of Patent: Jan. 18, 2005

(54) CABLE END CONNECTOR ASSEMBLY WITH DECREASING TRANSVERSE SIZE

(75) Inventor: Jie Cheng, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 14 days.

(21) Appl. No.: 10/310,493

(22) Filed: Dec. 4, 2002

(65) Prior Publication Data

US 2004/0097132 A1 May 20, 2004

(30) Foreign Application Priority Data

Nov. 15, 2002 (TW) ..... 91218337

(51) Int. Cl.[7] ..... H01R 13/58
(52) U.S. Cl. ..... 439/606
(58) Field of Search ..... 439/604, 606, 439/636, 660, 701, 736

(56) References Cited

U.S. PATENT DOCUMENTS 5,580,264 A * 12/1996 Aoyama et al. ..... 439/275
5,813,877 A * 9/1998 Nakamura ..... 439/267
6,325,670 B2 * 12/2001 Murayama ..... 439/587
6,402,552 B1 6/2002 Wagner
6,409,541 B1 * 6/2002 Hattori et al. ..... 439/587
6,585,537 B1 * 7/2003 Lee ..... 439/358

* cited by examiner

*Primary Examiner*—Thanh-Tam Le
(74) *Attorney, Agent, or Firm*—Wei Te Chung

(57) ABSTRACT

A cable end connector assembly (1) includes a dielectric housing (2), a plurality of contacts (3), a spacer (4), a cable (6), and a cover (5). The dielectric housing includes an upper wall (21), a lower wall (22) opposite to the upper wall, and first and second sidewalls (251, 252) connecting with the upper and lower walls. A cutout (28) is defined in the first sidewall adjacent to a rear end of the housing. The cable has a plurality of conductive cores (60) electrically connecting the contacts. The cover is over-molded with the rear end of the housing and a front end of the cable. A first lateral wall (531) of the cover is received in the cutout of the housing, and an outer surface of the first sidewall of the housing is coplanar with an outer surface of the first lateral wall.

6 Claims, 8 Drawing Sheets

CABLE END CONNECTOR ASSEMBLY WITH DECREASING TRANSVERSE SIZE

CROSS-REFERENCE TO RELATED APPLICATION

This patent application is a co-pending application of U.S. patent application Ser. No. 10/280,515, filed on Oct. 24, 2002, entitled "CABLE END CONNECTOR WITH LOCKING MEMBER" and Ser. No. 10/271,064, filed on Oct. 13, 2002, entitled "CABLE END CONNECTOR WITH LOCKING MEMBER", all invented by George Lee and assigned to the same assignee as this patent application.

BACKGROUND OF THE INVENTION

1. Field of the Invention

The present invention generally relates to a cable end connector assembly, and more particularly to a Serial ATA cable end connector assembly which has a decreasing transverse size for electrically connecting with a complementary electrical connector more reliably.

2. Description of Related Art

There exists in the art an electrical connector assembly known as a Serial Advanced Technology Attachment (Serial ATA) cable end connector assembly which is generally used for transmitting high-speed signals between disk drives and a mother board. Because of many advantages superior to Parallel ATA, Serial ATA has a possibility of replacing Parallel ATA and becomes the next transmitting generation.

The Serial ATA cable end connector assembly generally comprises a cable end connector and a cable connecting with the cable end connector. The assembly mates with a complementary electrical connector mounted on an edge of the mother board for transmitting signals. With the developing trend of integration and miniature of the mother board, electrical components of the mother board are arranged closely more and more, and the electrical components and connectors mounted on the edge of the mother board are usually arranged side by side and the interval therebetween is very small. If the transverse size of the cable end connector of the assembly is relatively large, the cable end connector interferes with other adjacent cable connector assemblies. The cable end connector assembly cannot mate with the complementary electrical connector reliably, thus, the signal transmission is influenced.

U.S. Pat. No. 6,402,552 (the Pat. '552) discloses such a Serial ATA cable end connector assembly comprising an electrical connector consisting of a dielectric housing and a contact module, a cable, and a cover over-molded with a front end of the cable. The contact module comprises a first housing piece received in a contact module receiving area and a plurality of contacts insert molded with the first housing piece. Tail portions of the contacts are exposed in an open communicating with the contact module receiving area. The tail portions are soldered with conductive cores of the cable respectively. The cover is over-molded with the tail portions of the contacts and the front ends of the conductive cores, and extends into the open. An outer surface of the cover and an outer surface of the housing are substantially on the same plane, so are the opposite outer surfaces. Thus, a transverse size of the electrical connector is decreased furthest and the connector will not interfere with other cable end connector assembly. However, the cover engages with the tail portions of the contacts, the front end of the cable and inner surfaces of the open only by friction. A user often grasps the cover to pull/insert the cable end connector assembly; thus, the cover is easy to break off. There exits in the art a solution of over-molding the cover over a rear end of the housing for attaining the cover to the housing more reliably. However, this increases the transverse size of the electrical connector and the connector interferes with other cable end connector assembly again.

Hence, a cable end connector assembly with a relatively small transverse size and a reliably attained cover is required to overcome the disadvantages of the related art.

SUMMARY OF THE INVENTION

An object of the present invention is to provide a cable end connector assembly which has a relatively small transverse size.

In order to achieve the objects set forth, a cable end connector assembly in accordance with the present invention comprises a dielectric housing, a plurality of contacts assembled in the dielectric housing, a cable and a cover. The dielectric housing comprises an upper wall, a lower wall opposite to the upper wall, and first and second sidewalls connecting the upper and lower walls. A cutout is defined in the first sidewall adjacent to a rear end of the housing. Each contact comprises a mating portion adapted for electrically connecting the complementary connector and a tail portion opposite to the mating portion. The cable has a plurality of conductive cores electrically connecting the contacts. The cover is over-molded with the rear end of the housing and a front end of the cable for protecting the electrical connection between the conductive cores and the contacts. A first lateral wall of the cover is received in the cutout of the housing, and an outer surface of the first sidewall of the housing is coplanar with an outer surface of the first lateral wall.

Other objects, advantages and novel features of the invention will become more apparent from the following detailed description when taken in conjunction with the accompanying drawings.

DETAILED DESCRIPTION OF THE INVENTION

Figure 1:
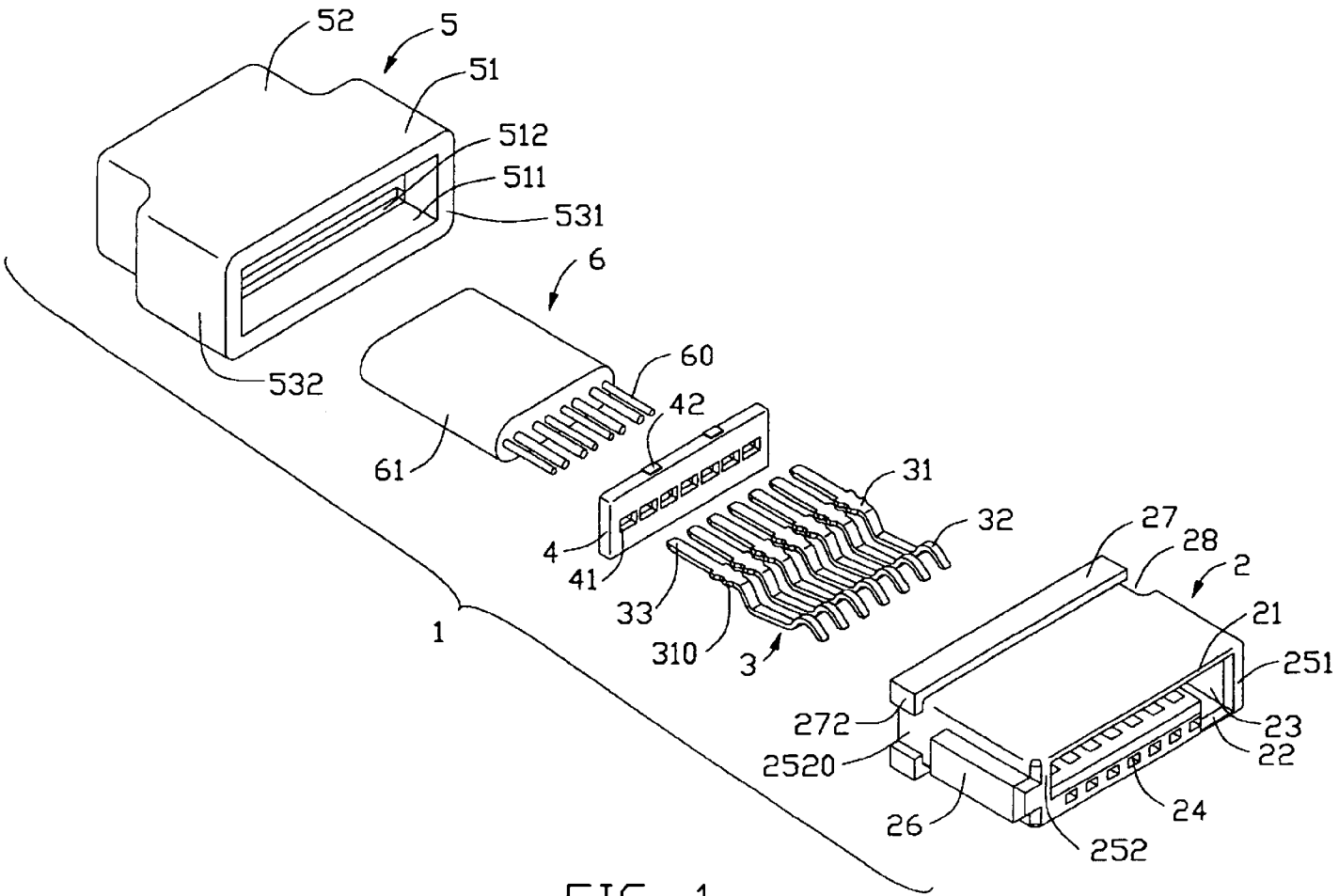
FIG. 1 is an exploded, perspective view of a cable end connector assembly in accordance with the present invention.
Figure 2:
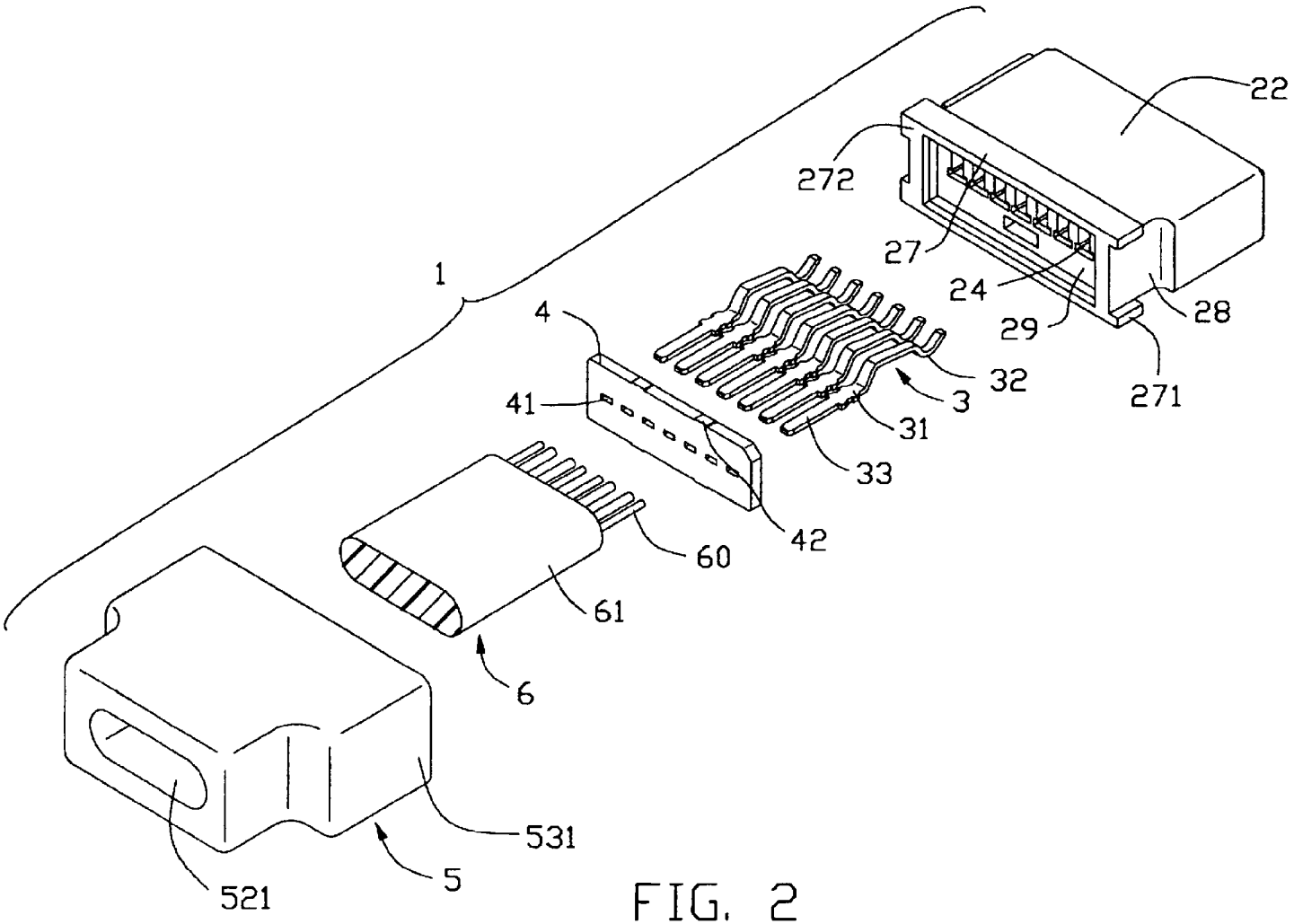
FIG. 2 is a view similar to FIG. 1, but taken from rear and bottom aspects.

Referring to FIGS. 1 and 2, a cable end connector assembly 1 in accordance with the present invention comprises a dielectric housing 2, a plurality of contacts 3, a spacer 4, a cover 5, and a cable 6. In the preferred embodiment of the present invention, the cable end connector assembly 1 is in the form of a Serial ATA cable end connector assembly.

Referring to FIGS. 1 to 4, the dielectric housing 2 is in the shape of a rectangular block and comprises an upper wall 21, a lower wall 22 opposite to the upper wall 21, and a first and a second sidewalls 251, 252 connecting the upper and lower walls 21, 22. The upper wall 21, the lower wall 22, and the first and second sidewalls 251, 252 together define an L-shaped receiving space 23 for receiving a mating portion of a complementary electrical connector. A plurality of passageways 24 is defined through the lower wall 22 from a rear end to a front end thereof. A guiding projection 26 protrudes sidewardly from an outer surface of the second sidewall 252. A cutout 28 is defined in the first sidewall 251 adjacent to the rear end of the housing 2 for decreasing a transverse size of the housing 2. A pair of parallel ribs 27 is formed on the upper and lower walls 21, 22 of the housing 2 adjacent to the rear end of the housing 2 respectively. A pair of first protrusions 271 is formed on one end of the ribs 27 respectively and extends beyond a periphery of the cutout 28 of the first sidewall 251. The extending width of the first protrusion 271 from the periphery of the cutout 28 is less than that of the first sidewall 251. A pair of second protrusions 272 is formed on the outer surface of the second sidewall 252. The second protrusions 272, the guiding projection 26 and the second sidewall 252 together define a channel 2520 in the rear end of the housing 2 for receiving melted plastic material of the cover 5. A receiving slot 29 is defined in the rear end of the housing 2 for receiving the spacer 4.

Each contact 3 comprises a retention portion 31, a mating portion 32 extending forwardly from the retention portion 31, and a tail portion 33 extending rearwardly from the retention portion 31. Each retention portion 31 forms a plurality of barbs 310 on a pair of sides thereof.

The spacer 4 is a rectangular board and defines a plurality of through holes 41 corresponding to the tail portions 33 of the contacts 3. An upper edge and a lower edge of the spacer 4 each forms a pair of tubers 42 for engaging with inner surfaces of the receiving slot 29.

The cover 5 is preferably comprised of molded plastic or polymer material and comprises a front receiving portion 51 and a cable receiving portion 52. The front receiving portion 51 comprises an upper and a lower walls, and a first and a second lateral walls 531, 532. The upper and lower walls, and the first and second lateral walls 531, 532 together define a receiving cavity 511 for receiving the rear end of the housing 2. A receiving opening 521 is defined in the cable receiving portion 52 for receiving the cable 6. A pair of slots 512 communicating with the receiving cavity 511 is defined in an inner upper wall and an inner lower wall of the cover 5 for receiving the ribs 27, and the first and second protrusions 271, 272 of the housing 2 therein.

The cable 6 comprises a plurality of conductive cores 60 surrounded by an outer insulating cover 61.

Figure 3:
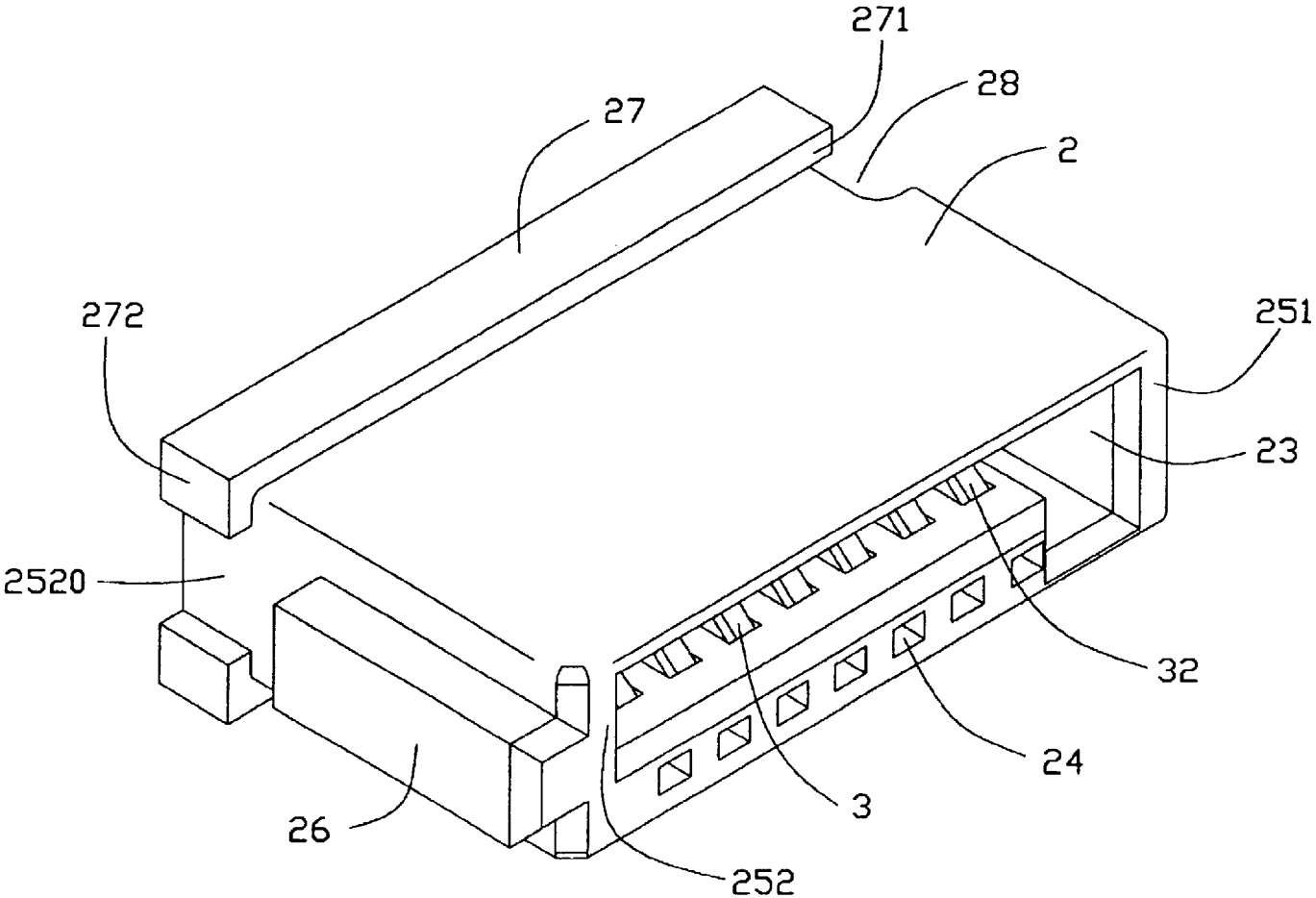
FIG. 3 is an assembled view of a dielectric housing, contacts and a spacer of the cable end connector assembly.
Figure 4:
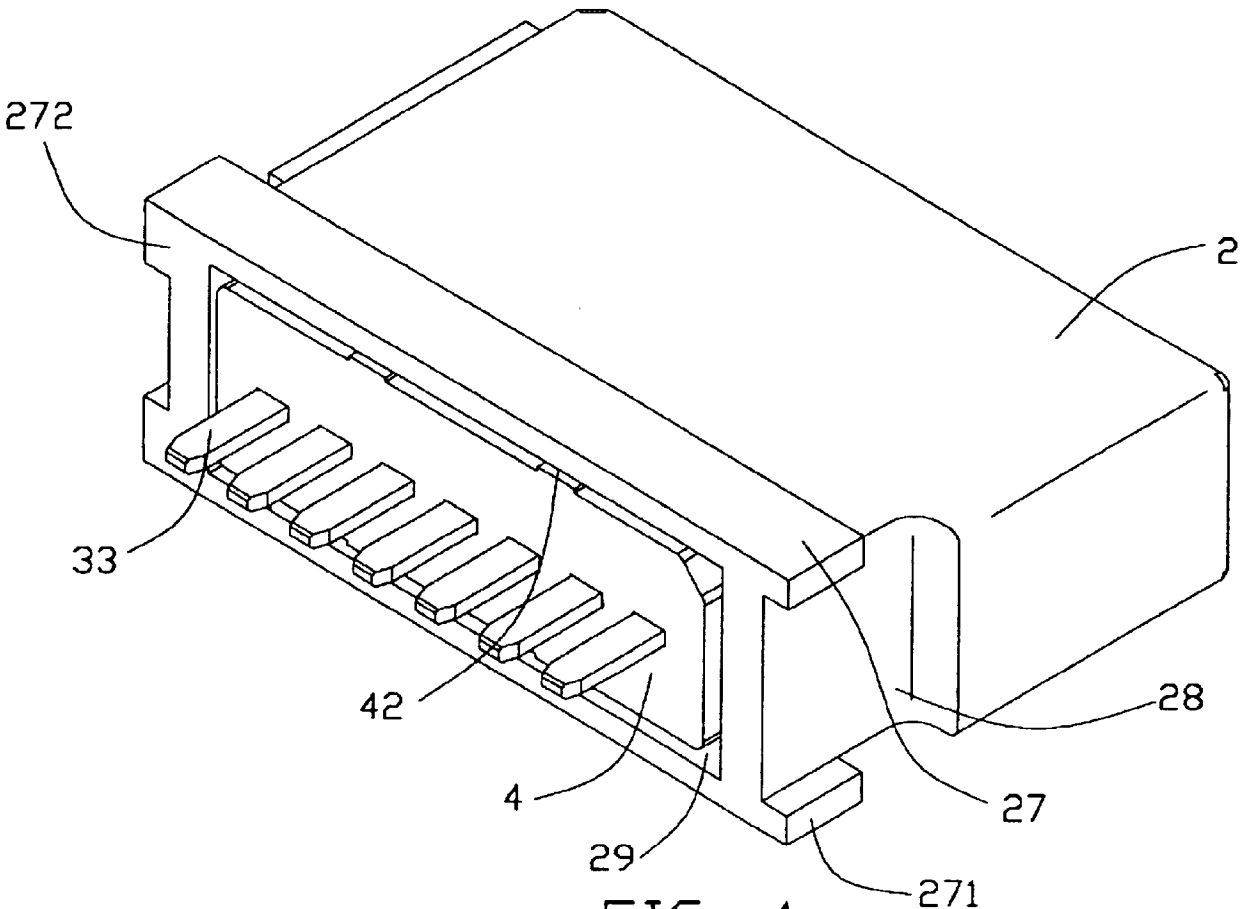
FIG. 4 is a view similar to FIG. 3, but taken from rear and bottom aspects.

In assembly, referring to FIGS. 3 and 4, the contacts 3 are first inserted into the dielectric housing 2 in a rear-to-front direction. Each mating portion 32 of the contact 3 protrudes through and is received in corresponding receiving passageway 24 and is partly exposed in the receiving space 23 for electrically connecting with the complementary electrical connector. Each retention portion 31 of the contact 3 is received in corresponding passageway 24 and the barbs 310 engage with opposite side surfaces of the passageway 24. The tail portion 33 of each contact 3 is exposed beyond a rear face of the housing 2 for being soldered with the cable 6. Then, the spacer 4 is pushed and received into the receiving slot 29 with the tubers 42 engaging with the inner surfaces of the receiving slot 29. The tail portions 33 protrude through the through holes 41 of the spacer 4, respectively. The spacer 4 seals the rear end of the housing 2 and efficiently prevents the melted plastic material of the cover 5 from entering into the housing 2 and causing influence the electrical connection between the cable end connector assembly 1 and the complementary electrical connector.

Figure 5:
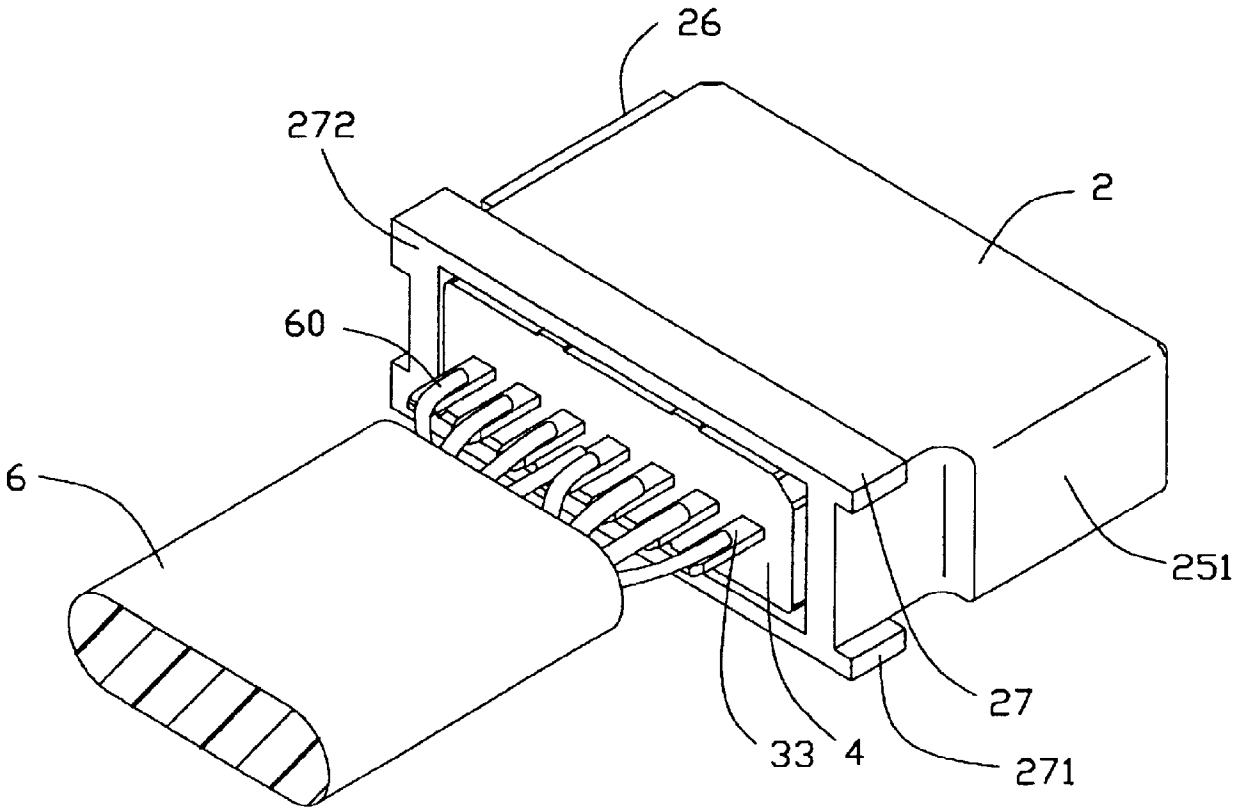
FIG. 5 is an assembled view of the cable end connector assembly without a cover from rear and bottom aspects.
Figure 6:
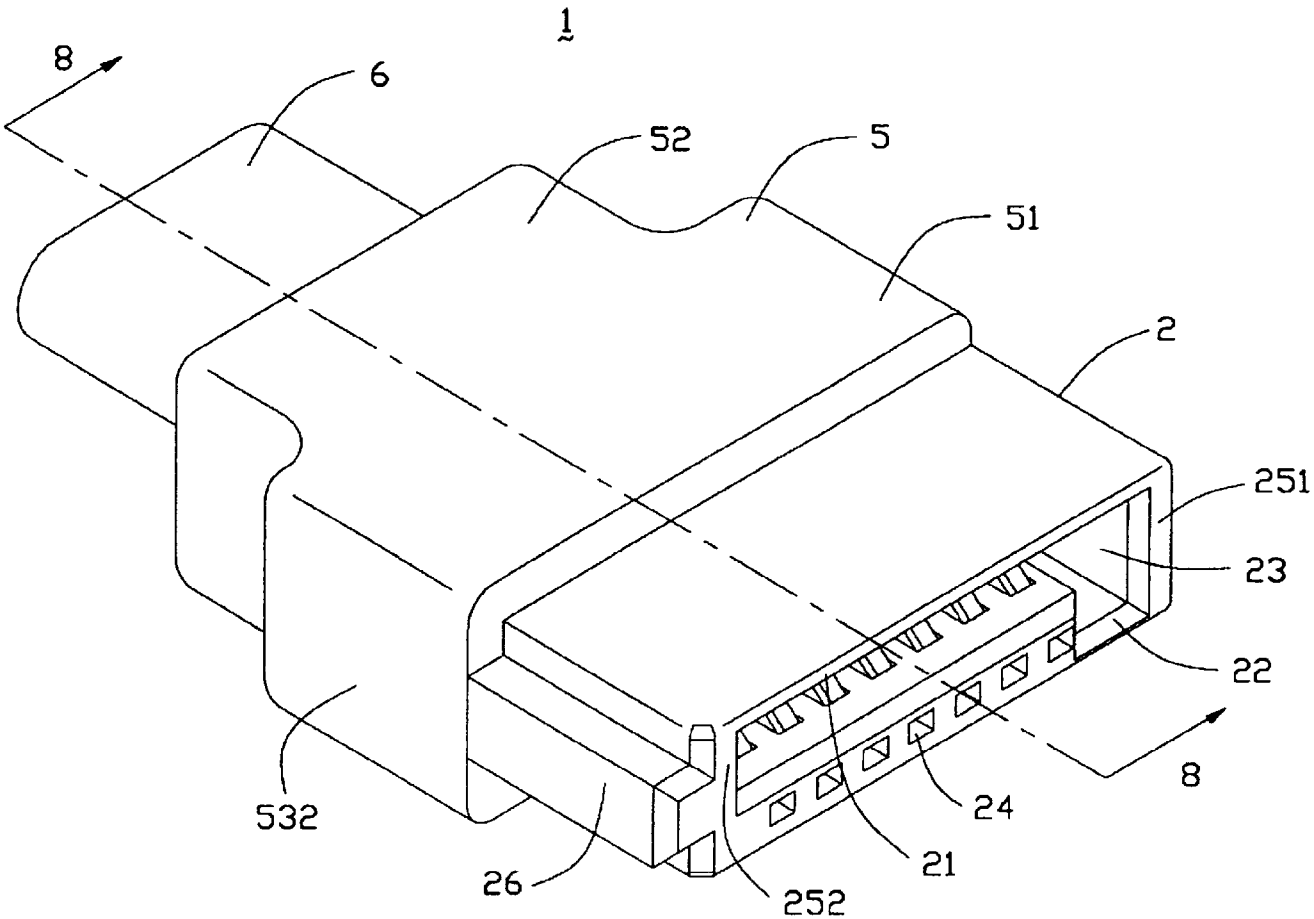
FIG. 6 is an assembled view of the cable end connector assembly of FIG. 1.
Figure 7:
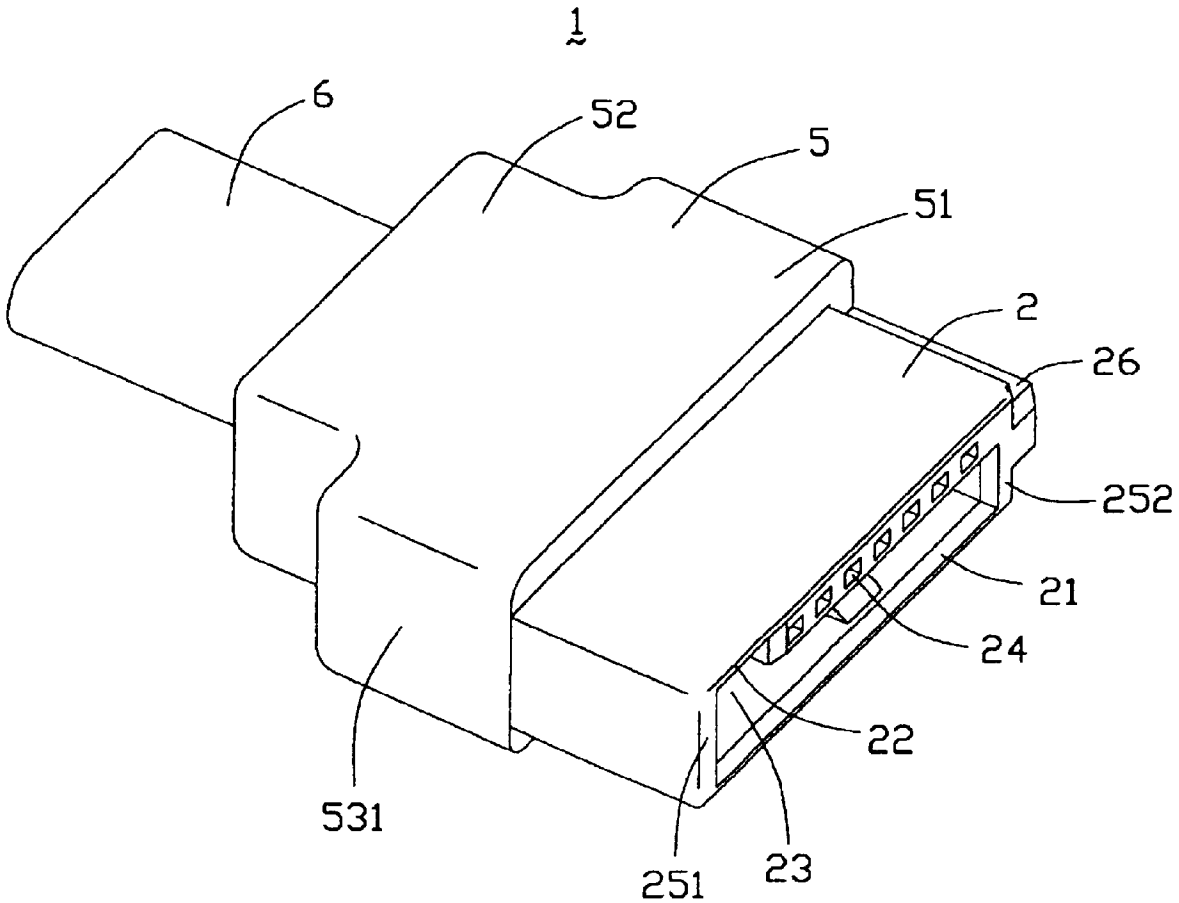
FIG. 7 is a reversed view of FIG. 6.
Figure 8:
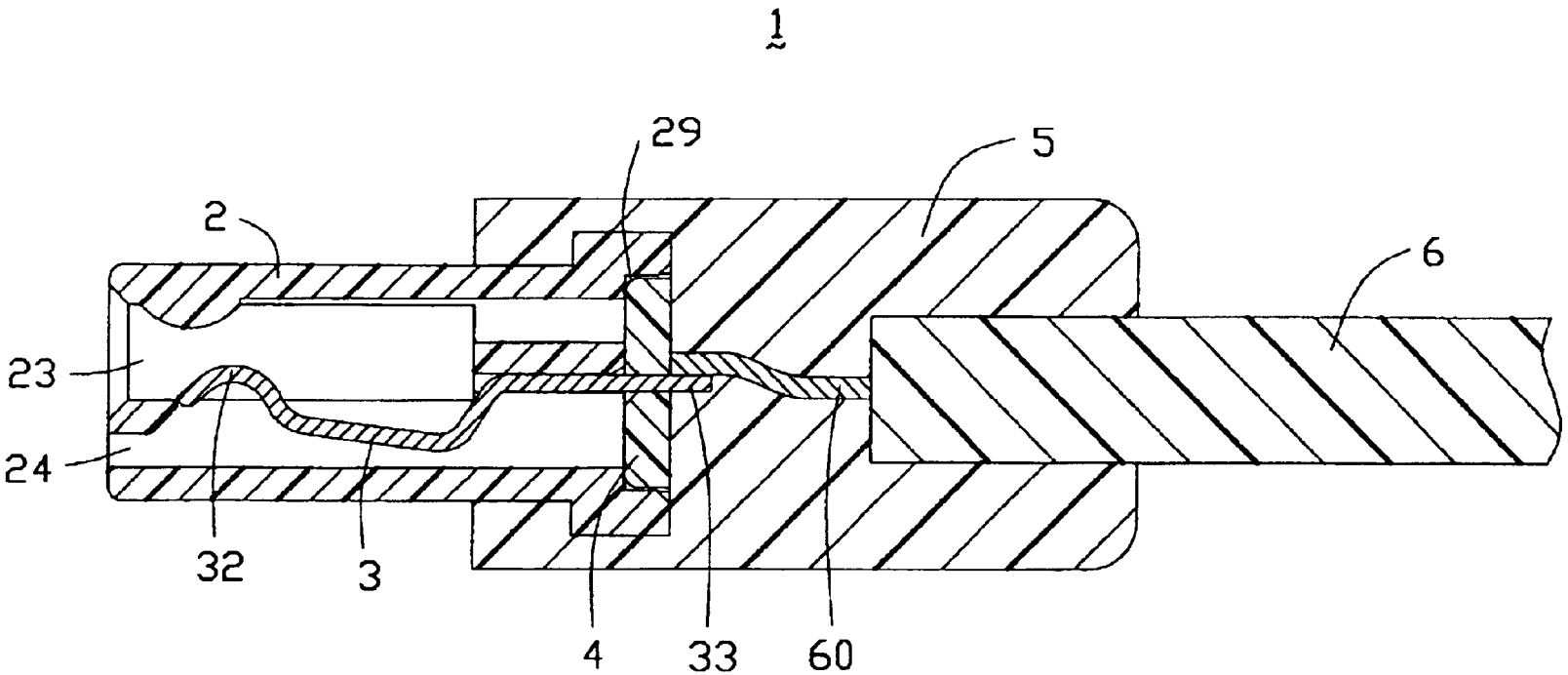
FIG. 8 is a cross-sectional view taken along line 8—8 of FIG. 7.

Now referring to FIG. 5, the conductive cores 60 of the cable 6 are soldered with the tail portions 33 of the contacts 3, respectively. Now referring to FIGS. 6 and 8, the cover 5 is over-molded with the rear end of the housing 2 and the front end of the cable 6. The rear end of the housing 2 and the front end of the cable 6 are received in the receiving cavity 511, the slots 512 and the receiving opening 521, respectively. The first lateral wall 531 of the cover 5 is received in the cutout 28 of the housing 2 when the first lateral wall 531 in solid state. The second lateral wall 532 is received in the channel 2520 of the housing 2 when the second lateral wall 532 in solid state. An outer surface of the first lateral wall 531 of the cover 5 is coplanar with the outer surface of the first sidewall 251 of the housing 2. An outer surface of the second lateral wall 532 of the cover 5 is coplanar with the outer surface of the guiding projection 26 of the housing 2. Thus, the transverse size of the housing 2 is decreased. The ribs 27, the first and second protrusions 271, 272 are received in the slots 512, and engage with inner walls of the receiving cavity 511 for providing retaining force between the housing 2 and the cover 5. Therefore, the housing 2 and the cover 5 engage with each other reliably. The cover 5 forms a strain relief between the housing 2 and the cable 6. The cover 5 also protects the electrical connection between the contacts 3 and the conductive cores 60 of the cable 6. Therefore, the cable end connector assembly 1 in accordance with the present invention achieves the goals of assuring the reliable engagement between the housing 2 and the cover 5, and decreasing the transverse size thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly adapted for mating with a complementary electrical connector, comprising:

a dielectric housing comprising an upper wall, a lower wall opposite to the upper wall, and a first and a second sidewalls connecting with the upper and lower walls, a cutout defined in the first sidewall adjacent to a rear edge of the housing, the second sidewall forming a guiding projection extending rearwardly from a front edge of the dielectric housing and terminated spaced from the rear edge of the dielectric housing with a distance and leaving a space on the back of the guiding projection, the dielectric housing defining a receiving slot in the rear edge thereof;

a plurality of contacts assembled in the dielectric housing, each contact comprising a mating portion adapted for electrically connecting the complementary connector and a tail portion opposite to the mating portion;

a spacer assembled to the dielectric housing and received in the receiving slot of the dielectric housing;

a cable having a plurality of conductive cores electrically connecting with the contacts; and a cover over-molded with the rear end of the housing and a front end of the cable for protecting the electrical connection between the conductive cores and the contacts, the cover occupying both said cutout and said space with two side edges thereof aligned with outer side edges of the first sidewall and the guiding projection, in a front to-back direction; wherein a pair of parallel ribs is formed on the upper and lower walls of the dielectric housing respectively and adjacent to the rear end of the housing; wherein a pair of first protrusions is formed on the ribs respectively and extends beyond a periphery of the cutout; wherein wherein a pair of second protrusions is formed on the second sidewall and adjacent to the ribs of the housing; wherein the cover comprises a front receiving portion receiving the rear end of the housing and a cable receiving portion receiving the front end of the cable, the front receiving portion comprises an upper and a lower walls connecting with the first and second lateral walls, the upper and lower walls and the first and second lateral walls together define a receiving cavity, the rear end of the housing is received in the receiving cavity; wherein a pair of slots is define in an inner upper wall and an inner lower wall of the cover and communicates with the receiving cavity, the ribs and the first and second protrusions are received in the slots, and engage with inner walls of the receiving cavity for providing retaining force between the housing and the cove.

2. The cable end connector assembly as claimed in claim 1, wherein each contact further comprises a retention portion connecting the mating portion and the tail potion, a plurality of barbs is formed on a pair of sides of the retention portion.

3. The cable end connector assembly as claimed in claim 2, wherein a plurality of passageways is defined through the lower wall of the housing from a rear end to a front end thereof, the contacts are received in the passageways respectively with the barbs of each retention portion engaging with opposite side surfaces of corresponding passageway.

4. The cable end connector assembly as claimed in claim 1, wherein the upper and lower walls, and the first and second sidewalls of the housing together define an L-shaped receiving space adapted for receiving a mating portion of the complementary electrical connector.

5. The cable end connector assembly as claimed in claim 1, wherein the spacer defines a plurality of through holes therein, and the tail portions of the contacts protrude through the through holes respectively and are soldered with the conductive cores of the cable.

6. A cable end connector assembly comprising:

an insulative housing defining therein a cavity with a plurality of terminals extending into said cavity;

said cavity being of a lying L-like configuration including a long section and a short section;

a guide projection formed on one side of said housing beside one end of said long section and opposite to said short section, said guide projection extending rearwardly from a front edge of the housing and terminated spaced from a rear edge of the housing with a distance and leaving a space on the back of the projection;

a cutout being formed on the other side of the housing adjacent to the rear edge of the housing, and a cover over-molded over a rear portion of the housing and occupying both said cutout and space; wherein two side edges of said cover are substantially symmetrically arranged by two sides of a center line of the housing; wherein said two side edges of the cover are aligned with two corresponding side edges of the housing, respectively, in a front-to-back direction so as to reduce a transverse dimension of said connector assembly; wherein said housing further includes at least one protrusion to interlock with the molded cover after molding so as to assure securement between the housing and the cover.

* * * * *